United States Patent [19]

Clason et al.

[11] 4,200,545

[45] * Apr. 29, 1980

[54] AMINO PHENOL-DETERGENT/DISPERSANT COMBINATIONS AND FUELS AND LUBRICANTS CONTAINING SAME

[75] Inventors: Donald L. Clason, Mentor; John F. Pindar, Euclid; Jerome M. Cohen, University Heights, all of Ohio

[73] Assignee: The Lubrizol Corporation, Wickliffe, Ohio

[ * ] Notice: The portion of the term of this patent subsequent to Jul. 11, 1995, has been disclaimed.

[21] Appl. No.: 921,624

[22] Filed: Jul. 3, 1978

Related U.S. Application Data

[63] Continuation-in-part of Ser. No. 653,177, Jan. 28, 1976, Pat. No. 4,100,082, which is a continuation-in-part of Ser. No. 701,938, Jul. 2, 1976.

[51] Int. Cl.[2] ..... C10M 1/40; C10M 1/36; C10M 1/32; C10M 3/34

[52] U.S. Cl. ..... 252/33.4; 44/58; 44/75; 252/32; 252/33; 252/42.7; 252/50; 252/51.5 R; 252/51.5 A; 260/571; 260/575

[58] Field of Search ..... 252/33, 33.4, 42.7, 252/32, 50, 51.5 A, 51.5 R; 44/58, 75; 260/575, 571

[56] References Cited

U.S. PATENT DOCUMENTS

| | | | |
|---|---|---|---|
| 2,571,092 | 10/1951 | Wasserman et al. | 260/575 |
| 2,758,086 | 8/1956 | Stuart et al. | 252/33 |
| 2,831,898 | 4/1958 | Ecke et al. | 260/575 |
| 2,862,883 | 12/1958 | Hughes et al. | 252/33 |
| 2,868,844 | 1/1959 | Coffield | 260/575 |
| 3,145,176 | 8/1964 | Knapp et al. | 252/33 |
| 3,932,288 | 1/1976 | Hoke | 252/33 |
| 4,100,082 | 7/1978 | Clason et al. | 252/33 |

FOREIGN PATENT DOCUMENTS

| | | | |
|---|---|---|---|
| 1007338 | 10/1965 | United Kingdom | 252/33 |

OTHER PUBLICATIONS

Chem. Abs., vol. 79, 1973, p. 88, 93745r, Detergent Compositions . . . Arai et al.

*Primary Examiner*—Irving Vaughn

*Attorney, Agent, or Firm*—James W. Adams, Jr.; Daniel N. Hall

[57] ABSTRACT

Disclosed are combinations of amino phenols, wherein said phenols contain a substantially saturated hydrocarbon substituent of at least 10 aliphatic carbon atoms, and one or more detergent/dispersants selected from the group consisting of (I) neutral or basic metal salts of an organic sulfur acid, phenol or carboxylic acid; (II) hydrocarbyl-substituted amines wherein the hydrocarbyl substituent is substantially aliphatic and contains at least 12 carbon atoms; (III) acylated nitrogen-containing compounds having a substituent of at least 10 aliphatic carbon atoms; and (IV) nitrogen-containing condensates of a phenol, aldehyde and amino compound. Fuels and lubricants containing such combinations as additives are particularly useful in two-cycle (two-stroke) engines.

71 Claims, No Drawings

AMINO PHENOL-DETERGENT/DISPERSANT COMBINATIONS AND FUELS AND LUBRICANTS CONTAINING SAME

REFERENCE TO RELATED APPLICATIONS

This application is a continuation-in-part of U.S. application Ser. No. 653,177 filed Jan. 28, 1976 now U.S. Pat. No. 4,100,082, and U.S. application Ser. No. 701,938, filed July 2, 1976.

BACKGROUND OF THE INVENTION (1) Field of the Invention

This invention relates to additive combinations useful in oils of lubricating viscosity and normally liquid fuels. More particularly, it relates to additive combinations of amino phenols with certain detergent/dispersants and to oils and fuels containing same which are especially useful in two-cycle engines.

(2) Prior Art

The book "Lubricant Additives" by M. W. Ranney, published by Noyes Data Corporation of Parkridge, New Jersey (1973), discloses a number of metal salts of various sulfonic and carboxylic acids and of phenols which are useful as detergent/dispersants in lubricating oil products. The book also entitled "Lubricant Additives" by C. V. Smallheer and R. K. Smith, published by the Lezius-Hiles Co. of Cleveland, Ohio (1967), similarly discloses a number of detergent/dispersants including sulfonates, phenates and carboxylates as well as alkyl and alkenyl succinimides and other high molecular weight amides and polyamides which are useful as dispersants. Other literature, particularly patents, which also disclose similar subject matter will be noted at appropriate points in the following specification.

(3) General Background

It is well known that additives are commonly added to engine lubricant and fuel compositions to prevent deposit formation on engine and fuel system surfaces with which the lubricant or fuel may come in contact. Such deposits interfere with proper circulation of lubricants in the engine. They can also act as abrasives to increase wear of engine parts; in extreme cases, such deposits may even hinder movement of engine parts. Deposits from fuels can interfere with proper carburetor operation, increase spark plug fouling, and the like.

Among the engines which utilize such lubricants and fuels are two-cycle (two-stroke), spark-ignited internal combustion engines including rotary engines such as the Wankel-type engine. Use of these types of engines has steadily increased over the past several decades and they are presently found in power lawn mowers and other power operated garden equipment, power chain saws, pumps, electrical generators, marine out-board engines, snow-mobiles, motorcycles, other light-weight wheeled vehicles and the like.

The increasing use of two-cycle engines, coupled with the increasing severity of the conditions under which they have been operated and the need to maximize usuage of petroleum-derived materials in the face of increasing shortages, has led to an increasing demand for oils and fuels which adequately lubricate such engines (it is a common practice to add the oils used to lubricate such engines to the fuel).

Among the problems associated with the lubrication of two-cycle engines are piston ring sticking, rusting, lubrication failure of connecting rod and main bearings, and deposit formation as noted above. The formation of varnish is a particularly vexatious problem since the build-up of varnish on piston and cylinder walls can cause loss of compression through seal failing. This is particularly damaging in two-cycle engines since they depend on suction to draw the new fuel charge into the exhausted cylinder.

The unique problems and techniques associated with the lubrication of two-cycle engines has led to a recognition in the art of two-cycle engine lubricants (and fuels containing same) as distinct types of lubricants and fuels. Similarly, additive concentrates for treating such fuels and lubricants have also been recognized to be a distinct field in the art. See, for example, U.S. Pat. Nos. 3,085,975; 3,004,837; and U.S. Pat. No. 3,753,905.

The inventions described herein include novel additive combinations for lubricating oils and normally liquid fuels, in general, and particularly for oils and fuels used in two-cycle engines.

(4) Objects

Therefore, it is an object of this invention to provide novel additive combinations.

It is a further object of this invention to provide novel lubricants, fuels and additive concentrates containing the novel additive combinations.

It is a particular object of this invention to provide novel additive combinations and lubricants and fuels containing the same for use in two-cycle, spark-ignited engines as well as novel means for operating such engines.

Other objects will be apparent to those skilled in the art upon review of the present specification.

SUMMARY OF THE INVENTION

This invention comprises a nitrogen-containing organic composition comprising a combination of:

(A) at least one amino phenol of the general formula

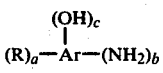

Formula I wherein R is a substantially saturated, hydrocarbon-based substituent of at least 10 aliphatic carbon atoms; a, b and c are each independently an integer of one up to three times the number of aromatic nuclei present in Ar, with the proviso that the sum of a, b and c does not exceed the unsatisfied valences of Ar; and Ar is an aromatic moiety having 0–3 optional substituents selected from the group consisting of lower alkyl, lower alkoxy, nitro, halo or combinations of two or more of said substituents; and (B) at least one detergent/dispersant selected from the group consisting of (I) at least one neutral or basic metal salt of an organic sulfur acid, phenol or carboxylic acid;

(II) at least one hydrocarbyl-substituted amine wherein the hydrocarbyl substituent is substantially aliphatic and contains at least twelve carbon atoms, with the proviso that said amine is not the amino phenol (A); (III) at least one acylated, nitrogen-containing compound having a substituent of at least 10 aliphatic carbon atoms made by reacting a carboxylic acid acylating agent with at least one amino compound containing at least one $>NH$ group, said acylating agent being linked to said amino compound through an imido, amido, amidine, or acyloxy ammonium linkage; and (IV) at least one nitrogen-containing condensate of a phenol, aldehyde and amino compound having at least one $>NH$ group.

Lubricants based on oils of lubricating viscosity and normally liquid engine fuels as well as additive concentrates containing the above-described combinations are also part of this invention.

DETAILED DESCRIPTION OF THE INVENTION (A) The Amino Phenols

The aromatic moiety, Ar, of Formula I can be a single aromatic nucleus such as a benzene nucleus, a pyridine nucleus, a thiophene nucleus, a 1,2,3,4-tetrahydronaphthalene nucleus, etc., or a polynuclear aromatic moiety. Such polynuclear moieties can be of the fused type; that is, wherein at least one aromatic nucleus is fused at two points to another nucleus such as found in naphthalene, anthracene, the azanaphthalenes, etc. Alternatively, such polynuclear aromatic moieties can be of the linked type wherein at least two nuclei (either mono- or polynuclear) are linked through bridging linkages to each other. Such bridging linkages can be chosen from the group consisting of carbon-to-carbon single bonds, ether linkages, keto linkages, sulfide linkages, polysulfide linkages of 2 to 6 sulfur atoms, sulfinyl linkages, sulfonyl linkages, methylene linkages, alkylene linkages, di-(lower alkyl)methylene linkages, lower alkylene ether linkages, alkylene keto linkages, lower alkylene sulfur linkages, lower alkylene polysulfide linkages of 2 to 6 carbon atoms, amino linkages, polyamino linkages and mixtures of such divalent bridging linkages. In certain instances, more than one bridging linkage can be present in Ar between aromatic nuclei. For example, a fluorene nucleus has two benzene nuclei linked by both a methylene linkage and a covalent bond. Such a nucleus may be considered to have 3 nuclei but only two of them are aromatic. Normally, however, Ar will contain only carbon atoms in the aromatic nuclei per se (plus any lower alkyl or alkoxy substituent present).

The number of aromatic nuclei, fused, linked or both, in Ar can play a role in determining the integer values of a, b and c in Formula I. For example, when Ar contains a single aromatic nucleus, a, b and c are each independently 1 to 4. When Ar contains two aromatic nuclei, a, b and c can each be an integer of 1 to 8, that is, up to three times the number of aromatic nuclei present (in naphthalene, 2). With a tri-nuclear Ar moiety, a, b and c can each be an integer of 1 to 12. For example, when Ar is a biphenyl or a naphthyl moiety, a, b and c can each independently be an integer of 1 to 8. The values of a, b and c are obviously limited by the fact that their sum cannot exceed the total unsatisfied valences of Ar.

The single ring aromatic nucleus which can be the Ar moiety can be represented by the general formula $$ar(Q)_m$$

wherein ar represents a single ring aromatic nucleus (e.g., benzene) of 4 to 10 carbons, each Q independently represents a lower alkyl group, lower alkoxy group, nitro group, or halogen atom, and m is 0 to 3. As used in this specification and appended claims, "lower" refers to groups having 7 or less carbon atoms such as lower alkyl and lower alkoxyl groups. Halogen atoms include fluorine, chlorine, bromine and iodine atoms; usually, the halogen atoms are fluorine and chlorine atoms.

Specific examples of single ring Ar moieties are the following:

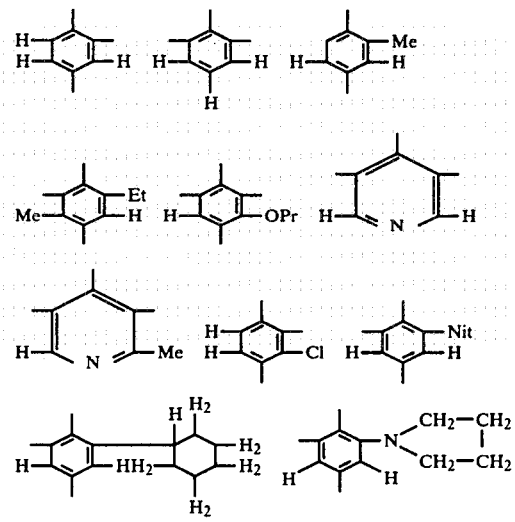

etc.

wherein Me is methyl, Et is ethyl, Pr is n-propyl, and Nit is nitro.

When Ar is a polynuclear fused-ring aromatic moiety, it can be represented by the general formula $$ar \not\subset ar \not\supset_{m'} (Q)_{mm'}$$

wherein ar, Q and m are as defined hereinabove, m' is 1 to 4 and $\supset$ represent a pair of fusing bonds fusing two rings so as to make two carbon atoms part of the rings of each of two adjacent rings. Specific examples of fused ring aromatic moieties Ar are:

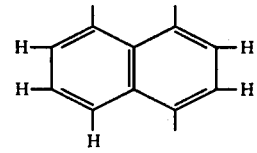

-continued

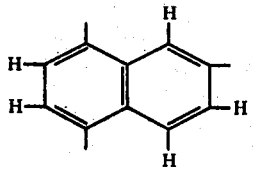

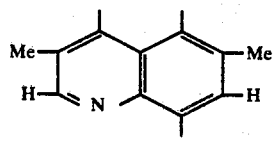

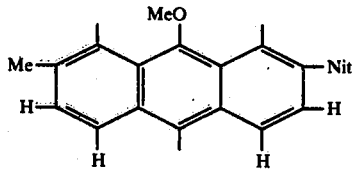

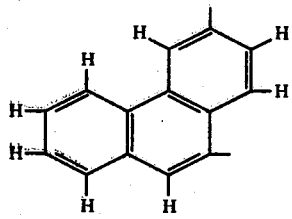

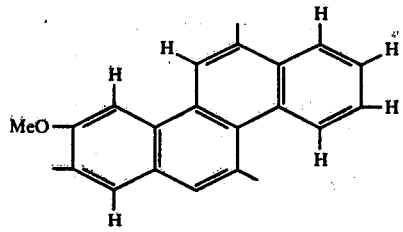

etc.

When the aromatic moiety Ar is a linked polynuclear aromatic moiety it can be represented by the general formula $$ar(—Lng\text{-}ar)_m(Q)_{mw}$$

wherein w is an integer of 1 to about 20, ar is as described above with the proviso that there are at least 3 unsatisfied (i.e., free) valences in the total of ar groups, Q and m are as defined hereinbefore, and each Lng is a bridging linkage individually chosen from the group consisting of carbon-to-carbon single bonds, ether linkages (e.g. —O—), keto linkages (e.g., $$-\overset{O}{\overset{\|}{C}}-),$$

sulfide linkages (e.g., —S—), polysulfide linkages of 2 to 6 sulfur atoms (e.g., $—S_{2-6}—$), sulfinyl linkages (e.g., —S(O)—), sulfonyl linkages (e.g., $—S(O)_2—$), lower alkylene linkages (e.g., $—CH_2—$, $—CH_2—CH_2—$, $$-CH-\underset{\underset{R^o}{|}}{CH}-,$$

etc.), di(lower alkyl)-methylene linkages (e.g., $CR^\circ{}_2—$), lower alkylene ether linkages (e.g., $—CH_2O—$, $—CH_2O—CH_2—$, $—CH_2—CH_2O—$, $—CH_2CH_2OCH_2CH_2—$, $$-CH_2\underset{\underset{R^o}{|}}{CHO}CH_2\underset{\underset{R^o}{|}}{CH}-,\ -CH_2\underset{\underset{R^o}{|}}{CHO}\underset{\underset{R^o}{|}}{CH}CH_2-,$$

etc.), lower alkylene sulfide linkages (e.g., wherein one or more —O—'s in the lower alkylene ether linkages is replaced with an —S— atom), lower alkylene polysulfide linkages (e.g., wherein one or more —O—'s is replaced with a $—S_{2-6}$ group), amino linkages (e.g., $$-\underset{\underset{H}{|}}{N}-,\ -\underset{\underset{R^o}{|}}{N}-,\ -CH_2\underset{\underset{|}{}}{N}-,\ -CH_2\underset{\underset{|}{}}{N}CH_2-,\ -alk\text{-}\underset{\underset{|}{}}{N}-,$$

where alk is lower alkylene, etc.), polyamino linkages (e.g., $$-\underset{\underset{|}{}}{N}(alk\underset{\underset{|}{}}{N})_{1-10},$$

where the unsatisfied free N valences are taken up with H atoms or R° groups), and mixtures of such bridging linkages (each R° being a lower alkyl group). It is also possible that one or more of the ar groups in the above-linked aromatic moiety can be replaced by fused nuclei such as ar ⋖ ar ⋗ $_{m'}$.

Specific examples of linked moieties are:

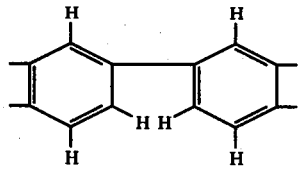

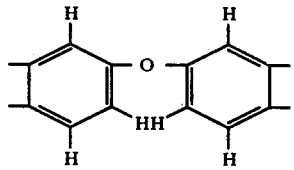

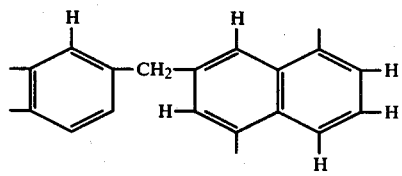

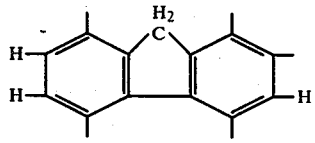

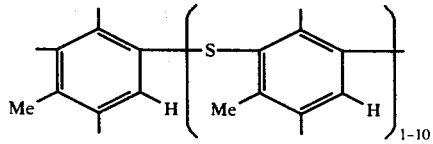

-continued

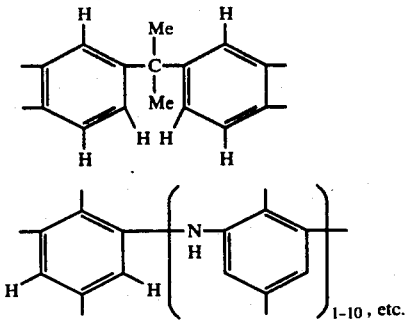

Usually all these Ar moieties are unsubstituted except for the R, —OH and —$NH_2$ groups (and any bridging groups).

For such reasons as cost, availability, performance, etc., the Ar moiety is normally a benzene nucleus, lower alkylene bridged benzene nucleus, or a naphthalene nucleus. Thus, a typical Ar moiety is a benzene or naphthalene nucleus having 3 to 5 unsatisfied valences, so that one or two of said valences may be satisfied by a hydroxyl group with the remaining unsatisfied valences being, insofar as possible, either ortho or para to a hydroxyl group. Preferably, Ar is a benzene nucleus having at least 3 unsatisfied valences so that one can be satisfied by a hydroxyl group with the remaining 2 or 3 being either ortho or para to the hydroxyl group.

THE SUBSTANTIALLY SATURATED HYDROCARBON-BASED GROUP R

The amino phenols of the present invention contain, directly bonded to the aromatic moiety Ar, a substantially saturated monovalent hydrocarbon-based group R of at least about 10 aliphatic carbon atoms. This R group can have up to about 400 aliphatic carbon atoms. More than one such group can be present, but usually, no more than 2 or 3 such groups are present for each aromatic nucleus in the aromatic moiety Ar. The total number of R groups present is indicated by the value for "a" in Formula I. Usually, the hydrocarbon-based group has at least about 30, more typically, at least about 50 aliphatic carbon atoms and up to about 750, more typically, up to about 300 aliphatic carbon atoms.

Generally, the hydrocarbon-based groups R are made from homo- or interpolymers (e.g., copolymers, terpolymers) of mono- and di-olefins having 2 to 10 carbon atoms, such as ethylene, propylene, butene-1, isobutene, butadiene, isoprene, 1-hexene, 1-octene, etc. Typically, these olefins are 1-monoolefins such as homopolymers of ethylene. The R groups can also be derived from the halogenated (e.g., chlorinated or brominated) analogs of such homo- or interpolymers. The R groups can, however, be made from other sources, such as monomeric high molecular weight alkenes (e.g., 1-tetracontene) and chlorinated analogs and hydrochlorinated analogs thereof, aliphatic petroleum fractions, particularly paraffin waxes and cracked and chlorinated analogs and hydrochlorinated analogs thereof, white oils, synthetic alkenes such as those produced by the Ziegler-Natta process (e.g., poly(ethylene) greases) and other sources known to those skilled in the art. Any unsaturation in the R groups may be reduced or eliminated by hydrogenation according to procedures known in the art before the nitration step described hereafter.

As used herein, the term "hydrocarbon-based" denotes a group having a carbon atom directly attached to the remainder of the molecule and having a predominantly hydrocarbon character within the context of this invention. Therefore, hydrocarbon-based groups can contain up to one non-hydrocarbon radical for every ten carbon atoms provided this non-hydrocarbon radical does not significantly alter the predominantly hydrocarbon character of the group. Those skilled in the art will be aware of such radicals, which include, for example, hydroxyl, halo (especially chloro and fluoro), alkoxyl, alkyl mercapto, alkyl sulfoxy, etc. Usually, however, the hydrocarbon-based groups R are purely hydrocarbyl and contain no such non-hydrocarbyl radicals.

The hydrocarbon-based groups R are substantially saturated. By substantially saturated it is meant that the group contains no more than one carbon-to-carbon unsaturated bond for every ten carbon-to-carbon single bonds present. Usually, they contain no more than one carbon-to-carbon non-aromatic unsaturated bond for every 50 carbon-to-carbon bonds present.

The hydrocarbon-based groups of the amino phenols of this invention are also substantially aliphatic in nature, that is, they contain no more than one non-aliphatic moiety (cycloalkyl, cycloalkenyl or aromatic) group of six or less carbon atoms for every ten carbon atoms in the R group. Usually, however, the R groups contain no more than one such non-aliphatic group for every fifty carbon atoms, and in many cases, they contain no such non-aliphatic groups at all; that is, the typical R groups are purely aliphatic. Typically, these purely aliphatic R groups are alkyl or alkenyl groups.

Specific examples of the substantially saturated hydrocarbon-based R groups are the following:

- a tetra(propylene) group
- a tri(isobutene) group
- a tetracontanyl group
- a henpentacontanyl group
- a mixture of poly(ethylene/propylene) groups of about 35 to about 70 carbon atoms
- a mixture of the oxidatively or mechanically degraded poly(ethylene/propylene) groups of about 35 to about 70 carbon atoms
- a mixture of poly(propylene/1-hexene) groups of about 80 to about 150 carbon atoms
- a mixture of poly(isobutene) groups having between 20 and 32 carbon atoms
- a mixture of poly(isobutene) groups having an average of 50 to 75 carbon atoms A preferred source of the group R are poly(isobutene)s obtained by polymerization of a $C_4$ refinery stream having a butene content of 35 to 75 weight percent and isobutene content of 15 to 60 weight percent in the presence of a Lewis acid catalyst such as aluminum trichloride or boron trifluoride. These polybutenes contain predominantly (greater than 80% of total repeating units) isobutene repeating units of the configuration

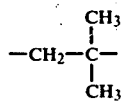

The attachment of the hydrocarbon-based group R to the aromatic moiety Ar of the amino phenols of this invention can be accomplished by a number of techniques well known to those skilled in the art. One particularly suitable technique is the Friedel-Crafts reaction, wherein an olefin (e.g., a polymer containing an olefinic bond), or halogenated or hydrohalogenated analog thereof, is reacted with a phenol. The reaction occurs in the presence of a Lewis acid catalyst (e.g., boron trifluoride and its complexes with ethers, phenols, hydrogen fluoride, etc., aluminum chloride, aluminum bromide, zinc dichloride, etc.). Methods and conditions for carrying out such reactions are well known to those skilled in the art. See, for example, the discussion in the article entitled, "Alkylation of Phenols" in "Kirk-Othmer Encyclopedia of Chemical Technology", Second Edition, Vol. 1, pages 894–895, Interscience Publishers, a division of John Wiley and Company, N.Y., 1963. Other equally appropriate and convenient techniques for attaching the hydrocarbon-based group R to the aromatic moiety Ar will occur readily to those skilled in the art.

As will be appreciated from inspection of Formula I the amino phenols of this invention contain at least one of each of the following substituents: a hydroxyl group, a R group as defined above, and a primary amine group, $—NH_2$. Each of the foregoing groups must be attached to a carbon atom which is a part of an aromatic nucleus in the Ar moiety. They need not, however, each be attached to the same aromatic ring if more than one aromatic nucleus is present in the Ar moiety.

In a preferred embodiment, the amino phenols of this invention contain one each of the foregoing substituents (i.e., a, b and c are each 1) and but a single aromatic ring, most preferably benzene. This preferred class of amino phenols can be represented by the formula

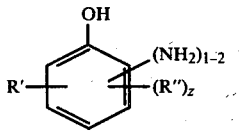

Formula II wherein the R' group is a substantially saturated hydrocarbon-based group of about 30 to about 400 aliphatic carbon atoms located ortho or para to the hydroxyl group, R'' is a lower alkyl, lower alkoxyl, nitro group or halogen atom and z is 0 or 1. Usually z is 0 and R' is a substantially saturated, purely hydrocarbyl aliphatic group. Often it is an alkyl or alkenyl group para to the —OH substituent. Often there is but one amino group, $—NH_2$ in these preferred amino phenols but there can be two.

In a still more preferred embodiment of this invention, the amino phenol is of the formula

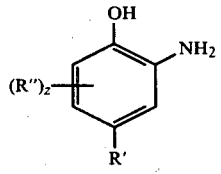

Formula III wherein R' is derived from homopolymerized or interpolymerized $C_{2-10}$ 1-olefins and has an average of from about 30 to about 400 aliphatic carbon atoms and R'' and z are as defined above. Usually R' is derived from ethylene, propylene, butylene and mixtures thereof. Typically, it is derived from polymerized isobutene. Often R' has at least about 50 aliphatic carbon atoms and z is 0.

The amino phenols of the present invention can be prepared by a number of synthetic routes. These routes can vary in the type reactions used and the sequence in which they are employed. For example, an aromatic hydrocarbon, such as benzene, can be alkylated with alkylating agent such as a polymeric olefin to form an alkylated aromatic intermediate. This intermediate can then be nitrated, for example, to form polynitro intermediate. The polynitro intermediate can in turn be reduced to a diamine, which can then be diazotized and reacted with water to convert one of the amino groups into a hydroxyl group and provide the desired amino phenol. Alternatively, one of the nitro groups in the polynitro intermediate can be converted to a hydroxyl group through fusion with caustic to provide a hydroxy-nitro alkylated aromatic which can then be reduced to provide the desired amino phenol.

Another useful route to the amino phenols of this invention involves the alkylation of a phenol with an olefinic alkylating agent to form an alkylated phenol. This alkylated phenol can then be nitrated to form an intermediate nitro phenol which can be converted to the desired amino phenols by reducing at least some of the nitro groups to amino groups.

Techniques for alkylating phenols are well known to those skilled in the art as the above-noted article in Kirk-Othmer "Encyclopedia of Chemical Technology" demonstrates. Techniques for nitrating phenols are also known. See, for example, in Kirk-Othmer "Encyclopedia of Chemical Technology", Second Edition, Vol. 13, the article entitled "Nitrophenols", page 888 et seq., as well as the treatises "Aromatic Substitution; Nitration and Halogenation" by P. B. D. De La Mare and J. H. Ridd, N.Y., Academic Press, 1959; "Nitration and Aromatic Reactivity" by J. G. Hogget, London, Cambridge University Press, 1961; and "The Chemistry of the Nitro and Nitroso Groups", Henry Feuer, Editor, Interscience Publishers, N.Y., 1969.

Aromatic hydroxy compounds can be nitrated with nitric acid, mixtures of nitric acid with acids such as sulfuric acid or boron trifluoride, nitrogen tetraoxide, nitronium tetrafluoroborates and acyl nitrates. Generally, nitric acid of a concentration of, for example, about 30–90% is a convenient nitrating reagent. Substantially inert liquid diluents and solvents such as acetic or butyric acid can aid in carrying out the reaction by improving reagent contact.

Conditions and concentrations for nitrating hydroxy aromatic compounds are also well known in the art. For example, the reaction can be carried out at temperatures of about −15° C. to about 150° C. Usually nitration is conveniently carried out between about 25°–75° C.

Generally, depending on the particular nitrating agent about 0.5–4 moles of nitrating agent is used for every mole of aromatic nucleus present in the hydroxy aromatic intermediate to be nitrated. If more than one aromatic nucleus is present in the Ar moiety, the amount of nitrating agent can be increased proportionately according to the number of such nuclei present. For example, a mole of naphthalene-based aromatic intermediate has, for purposes of this invention, the equivalent of two "single ring" aromatic nuclei so that about 1–4 moles of nitrating agent would generally be used. When nitric acid is used as a nitrating agent usually about 1.0 to about 3.0 moles per mole of aromatic nucleus is used. Up to about a 5-molar excess of nitrating agent (per "single ring" aromatic nucleus) may be used when it is desired to drive the reaction forward or carry it out rapidly.

Nitration of a hydroxy aromatic intermediate generally takes 0.25 to 24 hours, though it may be convenient to react the nitration mixture for longer periods, such as 96 hours.

Reduction of aromatic nitro compounds to the corresponding amines is also well known. See, for example, the article entitled "Amination by Reduction" in Kirk-Othmer "Encyclopedia of Chemical Technology", Second Edition, Vol. 2, pages 76-99. Generally, such reductions can be carried out with, for example, hydrogen, carbon monoxide or hydrazine, (or mixtures of same) in the presence of metallic catalysts such as palladium, platinum and its oxides, nickel, copper chromite, etc. Co-catalysts such as alkali or alkaline earth metal hydroxides or amines (including amino phenols) can be used in these catalyzed reductions.

Reduction can also be accomplished through the use of reducing metals in the presence of acids, such as hydrochloric acid. Typical reducing metals are zinc, iron and tin; salts of these metals can also be used.

Nitro groups can also be reduced in the Zinin reaction, which is discussed in "Organic Reactions", Vol. 20, John Wiley & Sons, N.Y., 1973, page 455 et seq. Generally, the Zinin reaction involves reduction of a nitro group with divalent negative sulfur compounds, such as alkali metal sulfides, polysulfides and hydrosulfides.

The nitro groups can be reduced by electrolytic action; see, for example, the "Amination by Reduction" article, referred to above.

Typically the amino phenols of this invention are obtained by reduction of nitro phenols with hydrogen in the presence of a metallic catalyst such as discussed above. This reduction is generally carried out at temperatures of about 15°-250° C., typically, about 50°-150° C., and hydrogen pressures of about 0-2000 psig, typically, about 50-250 psig. The reaction time for reduction usually varies between about 0.5-50 hours. Substantially inert liquid diluents and solvents, such as ethanol, cyclohexane, etc., can be used to facilitate the reaction. The amino phenol product is obtained by well-known techniques such as distillation, filtration, extraction, and so forth.

The reduction is carried out until at least about 50%, usually about 80%, of the nitro groups present in the nitro intermediate mixture are converted to amino groups. The typical route to the amino phenols of this invention just described can be summarized as (I) nitrating with at least one nitrating agent at least one compound of the formula

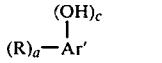

Formula IV wherein R is a substantially saturated hydrocarbon-based group of at least 10 aliphatic carbon atoms; a and c are each independently an integer of 1 up to three times the number of aromatic nuclei present in Ar with the proviso that the sum of a, b and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar' is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

Usually this means reducing at least about 50% of the nitro groups to amino groups in a compound or mixture of compounds of the formula

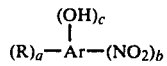

Formula V wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

(B) The Detergent/Dispersants

In general the detergent/dispersants (B) used in the combinations of this invention are materials known to those skilled in the art and they have been described in numerous books, articles and patents. A number of these are noted hereinbelow in relation to specific types of detergent/dispersants and where this is done it is to be understood that they are incorporated by reference for their disclosures relevant to the subject matter discussed at the point in the specification in which they are identified.

(B) (I) The Neutral or Basic Metal Salts of Organic Sulfur Acids, Carboxylic Acids or Phenols The choice of metal used to make these salts is usually not critical and therefore virtually any metal can be used. For reasons of availability, cost and maximum effectiveness, certain metals are more commonly used. These include the alkali and alkaline earth metals (i.e., the Group IA and IIA metals excluding francium and radium). Group IIB metals as well as polyvalent metals such as aluminum, chromium, molybdenum, wolfram, manganese, iron, cobalt, nickel, and copper can also be used. Salts containing a mixture of ions of two or more of these metals are often used.

These salts can be neutral or basic. The former contain an amount of metal cation just sufficient to neutralize the acidic groups present in salt anion; the former contain an excess of metal cation and are often termed overbased, hyperbased or superbased salts.

These basic and neutral salts can be of oil-soluble organic sulfur acids such as sulfonic, sulfamic, thiosulfonic, sulfinic, sulfenic, partial ester sulfuric, sulfurous and thiosulfuric acid. Generally they are salts of carbocyclic or aliphatic sulfonic acids.

The carbocyclic sulfonic acids include the mono- or poly-nuclear aromatic or cycloaliphatic compounds.

The oil-soluble sulfonates can be represented for the most part by the following formulae:

$$[R_x—T—(SO_3)_y]_zM_b \quad \text{Formula VI}$$

$$[R'—(SO_3)_a]_dM_b \quad \text{Formula VII}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.; R in Formula VI is an aliphatic group such as alkyl, alkenyl, alkoxy, alkoxyalkyl, carboalkoxyalkyl, etc.; x is at least 1, and $R_x$+T contains a total of at least about 15 carbon atoms. R' in Formula VII is an aliphatic radical containing at least about 15 carbon atoms and M is either a metal cation or hydrogen. Examples of types of the R' radical are alkyl, alkenyl, alkoxyalkyl, carboalkoxyalkyl, etc. Specific examples of R' are groups derived from petroleum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and R' in the above formulae can also contain other inorganic or organic substituents in addition to those enumerated above such as, for example, hydroxy, mercapto, halogen, nitro, amino, nitroso, sulfide, disulfide, etc. In Formula VI, x, y, z and b are at least 1, and likewise in Formula VII, a, b and d are at least 1.

The following are specific examples of oil-soluble sulfonic acids coming within the scope of Formulae I and II above, and it is to be understood that such examples serve also to illustrate the salts of such sulfonic acids useful in this invention. In other words, for every sulfonic acid enumerated it is intended that the corresponding neutral and basic metal salts thereof are also understood to be illustrated. Such sulfonic acids are mahogany sulfonic acids; bright stock sulfonic acids; sulfonic acids derived from lubricating oil fractions having a Saybolt viscosity from about 100 seconds at 100° F. to about 200 seconds at 210° F.; petrolatum sulfonic acids; mono- and poly-wax substituted sulfonic and polysulfonic acids of, e.g., benzene, naphthalene, phenol, diphenyl ether, naphthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acids, dicapryl nitronaphthalene sulfonic acids, and alkaryl sulfonic acids such as dodecyl benzene "bottoms" sulfonic acids.

The latter are acids derived from benzene which has been alkylated with propylene tetramers or isobutene trimers to introduce 1, 2, 3, or more branched-chain $C_{12}$ substituents on the benzene ring. Dodecyl benzene bottoms, principally mixtures of mono- and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 et seq. published by John Wiley & Sons, N.Y. (1969).

Other descriptions of neutral and basic sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,233,676; 2,239,974; 2,263,312; 2,276,090; 2,276,097; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, mono- or poly-wax substituted cyclohexyl sulfonic acids, etc.

With respect to the sulfonic acids or salts thereof described herein and in the appended claims, it is intended herein to employ the term "petroleum sulfonic acids" or "petroleum sulfonates" to cover all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB neutral and basic salts of the above-described synthetic and petroleum sulfonic acids are useful in the practice of this invention.

The carboxylic acids from which suitable neutral and basic salts for use in this invention can be made include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least eight carbon atoms and preferably at least twelve carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, α-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyl-octahydroindene carboxylic acid, palmitic acid, commercially available mixtures of two or more carboxylic acids such as tall oil acids, rosein acids, and the like.

A preferred group of oil-soluble carboxylic acids useful in preparing the salts used in the present invention are the oil-soluble aromatic carboxylic acids. These acids are represented by the general formula:

Formula VIII

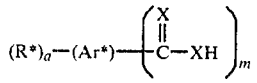

where R* is an aliphatic hydrocarbon-based group of at least four carbon atoms, and no more than about 400 aliphatic carbon atoms, a is an integer of from one to four, Ar* is a polyvalent aromatic hydrocarbon nucleus of up to about 14 carbon atoms each X is independently a sulfur or oxygen atom, and m is an integer of from one to four with the proviso that R* and a are such that there is an average of at least 8 aliphatic carbon atoms provided by the R* groups for each acid molecule represented by Formula VIII. Examples of aromatic nuclei represented by the variable Ar* are the polyvalent aromatic radicals derived from benzene, naphthalene, anthracene, phenanthrene, indene, fluorene, biphenyl, and the like. Generally, the radical represented by Ar* will be a polyvalent nucleus derived from benzene or naphthalene such as phenylenes and naphthylene, e.g., methylphenylenes, ethoxyphenylenes, nitrophenylenes, isopropylphenylenes, hydroxyphenylenes, mercaptophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually purely hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e., =O), thio groups (i.e., =S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-chlorohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain non-hydrocarbon substituents, for example, such diverse substituents as lower alkoxy, lower alkyl mercapto, nitro, halo, alkyl or alkenyl groups of less than four carbon atoms, hydroxy, mercapto, and the like.

A group of particularly useful carboxylic acids are those of the formula:

Formula IX

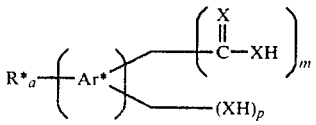

where R*, X, Ar*, m and a are as defined in Formula VIII and p is an integer of 1 to 4, usually 1 or 2. Within this group, an especially preferred class of oil-soluble carboxylic acids are those of the formula:

Formula X

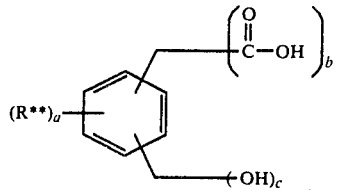

where R in Formula X is an aliphatic hydrocarbon group containing at least 4 to about 400 carbon atoms, a is an integer of from 1 to 3, b is 1 or 2, c is zero, 1, or 2 and preferably 1 with the proviso that R and a are such that the acid molecules contain at least an average of about twelve aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about sixteen carbon atoms per substituent and one to three substituents per molecule are particularly useful. Salts prepared from such salicylic acids wherein the aliphatic hydrocarbon substituents are derived from polymerized olefins, particularly polymerized lower 1-mono-olefins such as polyethylene, polypropylene, polisobutylene, ethylene/propylene copolymers and the like and having average carbon contents of about 30 to about 400 carbon atoms.

The carboxylic acids corresponding to Formulae VIII–IX above are well known or can be prepared according to procedures known in the art. Carboxylic acids of the type illustrated by the above formulae and processes for preparing their neutral and basic metal salts are well known and disclosed, for example, in such U.S. Pat. Nos. as 2,197,832; 2,197,835; 2,252,662; 2,252,664; 2,714,092, 3,410,798 and 3,595,791.

Another type of neutral and basic carboxylate salt used in this invention are those derived from alkenyl succinates of the general formula Formula XI

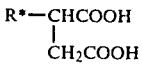

wherein R* is as defined above in Formula VIII. Such salts and means for making them are set forth in U.S. Pat. Nos. 3,271,130, 3,567,637 and 3,632,510, which are hereby incorporated by reference in this regard.

Other patents specifically describing techniques for making basic salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,396; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

Neutral and basic salts of phenols (generally known as phenates) are also useful in the compositions of this invention and well known to those skilled in the art. The phenols from which these phenates are formed are of the general formula $$(R^*)_n(Ar^*)(XH)_m \qquad \text{Formula XII}$$

wherein R*, n, Ar*, X and m have the same meaning and preferences as described hereinabove with reference to Formula VIII. The same examples described with respect to Formula VIII also apply.

A commonly available class of phenates are those made from phenols of the general formula Formula XIII

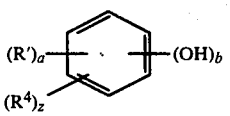

wherein a is an integer of 1–3, b is of 1 or 2, z is 0 or 1, R′ in Formula XIII is a substantially saturated hydrocarbon-based substituent having an average of from 30 to about 400 aliphatic carbon atoms and $R^4$ is selected from the group consisting of lower alkyl, lower alkoxyl, nitro, and halo groups.

One particular class of phenates for use in this invention are the basic (i.e., overbased, etc.) Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971 and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Patent 3,350,038; particularly columns 6–8 thereof, which is hereby incorporated by reference for its disclosures in this regard.

Naturally, mixtures of two or more neutral and basic salts of the hereinabove described organic sulfur acid, carboxylic acids and phenols can be used in the compositions of this invention. Usually the neutral and basic salts will be sodium, lithium, magnesium, calcium, or barium salts including mixtures of two or more of any of these.

(B) (II) The Hydrocarbyl-Substituted Amine

The hydrocarbyl-substituted amines used in making the compositions of this invention are well known to those of skill in the art and they are described in a number of patents. Among these are U.S. Pat. Nos. 3,275,554; 3,438,757; 3,454,555; 3,565,804; 3,755,433; and 3,822,209. These patents are hereby incorporated by their reference for their disclosure of suitable hydrocarbyl amines for use in the present invention including their method of preparation.

A typical hydrocarbyl amine has the general formula:

Formula XIV

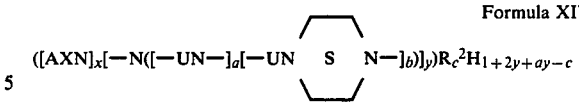

wherein A is hydrogen, a hydrocarbyl group of from 1 to 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A to form a ring of from 5 to 6 annular members and up to 12 carbon atoms; U is an alkylene group of from 2 to 10 carbon atoms, $R^2$ is an aliphatic hydrocarbon group of from about 30 to 400 carbon atoms; a is an integer of from 0 to 10; b is an integer of from 0 to 1; $a+2b$ is an integer of from 1 to 10; c is an integer of from 1 to 5 and is as an average in the range of 1 to 4, and equal to or less than the number of nitrogen atoms in the molecule; x is an integer of from 0 to 1; y is an integer of from 0 to 1; and $x+y$ is equal to 1.

In interpreting this formula, it is to be understood that the $R^2$ and H atoms are attached to the unsatisfied nitrogen valences within the brackets of the formula. Thus, for example, the formula includes subgeneric formulae wherein the $R^2$ is attached to terminal nitrogens and isomeric subgeneric formula wherein it is attached to non-terminal nitrogen atoms. Nitrogen atoms not attached to an $R^2$ may bear a hydrogen or an AXN substituent.

The hydrocarbyl amines useful in this invention and embraced by the above formula include monoamines of the general formula $$AXNR^2. \qquad \text{Formula XV}$$

Illustrative of such monoamines are the following:

poly(propylene)amine
N,N-dimethyl-N-poly(ethylene/propylene)amine (50:50 mole ratio of monomers)
poly(isobutene)amine
N,N-di(hydroxyethyl)-N-poly(isobutene)amine
poly(isobutene/1-butene/2-butene)amine (50:25:25 mole ratio of monomer)
N-(2-hydroxypropyl)-N-poly(isobutene)amine
N-poly(1-butene)-aniline
N-poly(isobutene)-morpholine Among the hydrocarbyl amines embraced by the general Formula XIV as set forth above, are polyamines of the general formula Formula XVI

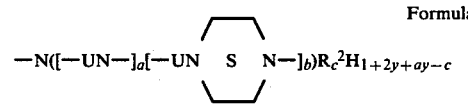

Illustrative of such polyamines are the following:

N-poly(isobutene) ethylene diamine
N-poly(propylene) trimethylene diamine
N-poly(1-butene) diethylene triamine
N′,N′-poly(isobutene) tetraethylene pentamine
N,N-dimethyl-N′-poly(propylene),1,3-propylene diamine The hydrocarbyl substituted amines useful in forming the compositions in this invention include certain N-aminohydrocarbyl morpholines which are not embraced in the general Formula XIV above. These hydrocarbyl-substituted aminohydrocarbyl morpholines have the general formula:

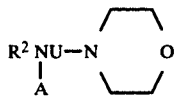

Formula XVII wherein $R^2$ is an aliphatic hydrocarbon group of from about 30 to about 400 carbons, A is hydrogen, hydrocarbyl of from 1 to 10 carbon atoms or hydroxy hydrocarbyl group of from 1 to 10 carbon atoms and U is an alkylene group of from 2 to 10 carbon atoms. These hydrocarbyl-substituted aminohydrocarbyl morpholines as well as the polyamines described by Formula XV are among the typical hydrocarbyl-substituted amines used in preparing compositions of this invention.

(B) (III) The Acylated Nitrogen-containing Compounds

A number of acylated, nitrogen-containing compounds having a substituent of at least 10 aliphatic carbon atoms and made by reacting a carboxylic acid acylating agent with an amino compound are known to those skilled in the art. In such compositions the acylating agent is linked to the amino compound through an imido, amido, amidine or acyloxy ammonium linkage. The substituent of 10 aliphatic carbon atoms may be in either the carboxylic acid acylating agent derived portion of the molecule or in the amino compound derived portion of the molecule. Preferably, however, it is in the acylating agent portion. The acylating agent can vary from formic acid and its acylating derivatives to acylating agents having high molecular weight aliphatic substituents of up to 5,000, 10,000 or 20,000 carbon atoms. The amino compounds can vary from ammonia itself to amines having aliphatic substituents of up to about 30 carbon atoms.

A typical class of acylated amino compounds useful in making the compositions of this invention are those made by reacting an acylating agent having an aliphatic substituent of at least 10 carbon atoms and a nitrogen compound characterized by the presence of at least one

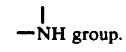

group.

Typically, the acylating agent will be a mono- or polycarboxylic acid (or reactive equivalent thereof) such as a substituted succinic or propionic acid and the amino compound will be a polyamine or mixture of polyamines, most typically, a mixture of ethylene polyamines. The aliphatic substituent in such acylating agents is often of at least about 50 and up to about 400 carbon atoms. Usually it belongs to the same generic class as the R′ group of the amino phenols (A) and therefore the preferences, examples and limitations discussed hereinabove relating to R′ apply equally to this aliphatic substituent. Exemplary of amino compounds useful in making these acylated compounds are the following:

(1) polyalkylene polyamines of the general formula

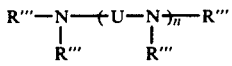

Formula XVIII wherein each R‴ is independently a hydrogen atom or a $C_{1-12}$ hydrocarbon-based group, with proviso that at least one R is a hydrogen atom, n is a whole number of 1 to 10 and U is a $C_{2-10}$ alkylene group, (2) heterocyclic-substituted polyamines of the formula

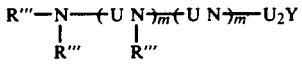

Formula XIX wherein R‴ and U are as defined hereinabove, m is 0 or a whole number of 1 to 10, m′ is a whole number of 1 to 10 and Y is an oxygen or divalent sulfur atom or a

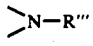

group and (3) aromatic polyamines of the general formula $$Ar(NR'''_2)_y$$

Formula XX wherein Ar is an aromatic nucleus of 6 to about 20 carbon atoms, each R‴ is as defined hereinabove and y is 2 to about 8. Specific examples of the polyalkylene polyamines (1) are ethylene diamine, tetra(ethylene)-pentamine, tri(trimethylene)tetramine, 1,2-propylene diamine, etc. Specific examples of the heterocyclic-substituted polyamines (2) are N-2-aminoethyl piperazine, N-2 and N-3 amino propyl morpholine, N-3-(dimethyl amino) propyl piperazine, etc. Specific examples of the aromatic polyamines (3) are the various isomeric phenylene diamines, the various isomeric naphthylene diamines, etc.

Many patents have described useful acylated nitrogen compounds including U.S. Pat. Nos. 3,172,892; 3,219,666; 3,272,746; 3,310,492; 3,341,542; 3,444,170; 3,455,831; 3,455,832; 3,576,743; 3,630,904; 3,632,511; and U.S. Pat. No. 3,804,763. A typical acylated nitrogen-containing compound of this class is that made by reacting a poly(isobutene)-substituted succinic anhydride acylating agent (e.g., anhydride, acid, ester, etc.) wherein the poly(isobutene) substituent has between about 50 to about 400 carbon atoms with a mixture of ethylene polyamines having 3 to about 7 amino nitrogen atoms per ethylene polyamine and about 1 to about 6 ethylene units made from condensation of ammonia with ethylene chloride. In view of the extensive disclosure of this type of acylated amino compound, further discussion of their nature and method of preparation is not needed here. Instead, the abovenoted U.S. Patents are hereby incorporated by reference for their disclosure of acylated amino compounds and their method of preparation.

Another type of acylated nitrogen compound belonging to this class is that made by reacting the afore-described alkylene amines with the afore-described substituted succinic acids or anhydrides and aliphatic mono-carboxylic acids having from 2 to about 22 carbon atoms. In these types of acylated nitrogen compounds, the mole ratio of succinic acid to mono-carboxylic acid ranges from about 1:0.1 to about 1:1. Typical of the mono-carboxylic acid are formic acid, acetic acid, dodecanoic acid, butanoic acid, oleic acid, stearic acid, the commercial mixture of stearic acid isomers known as isostearic acid, tolyl acid, etc. Such materials are more fully described in U.S. Pat. No. 3,216,936 and U.S. Pat. No. 3,250,715 which are hereby incorporated by reference for their disclosures in this regard.

Still another type of acylated nitrogen compound useful in making the compositions of this invention is the product of the reaction of a fatty monocarboxylic acid of about 12–30 carbon atoms and the afore-described alkylene amines, typically, ethylene, propylene or trimethylene polyamines containing 2 to 8 amino groups and mixtures thereof. The fatty monocarboxylic acids are generally mixtures of straight and branched chain fatty carboxylic acids containing 12–30 carbon atoms. A widely used type of acylated nitrogen compound is made by reacting the afore-described alkylene polyamines with a mixture of fatty acids having from 5 to about 30 mole percent straight chain acid and about 70 to about 95 percent mole branched chain fatty acids. Among the commercially available mixtures are those known widely in the trade as isostearic acid. These mixtures are produced as a by-product from the dimerization of unsaturated fatty acids as described in U.S. Pat. No. 2,812,342 and U.S. Pat. No. 3,260,671.

The branched chain fatty acids can also include those in which the branch is not alkyl in nature, such as found in phenyl and cyclohexyl stearic acid and the chlorostearic acids. Branched chain fatty carboxylic acid-/alkylene polyamine products have been described extensively in the art. See for example, U.S. Pat. Nos. 3,110,673; 3,251,853; 3,326,801; 3,337,459; 3,405,064; 3,429,674; 3,468,639; 3,857,791. These patents are hereby incorporated by reference for their disclosure of fatty acid/polyamine condensates and their use in lubricating oil formulations.

(B) (IV) The Nitrogen-containing Condensates of Phenols, Aldehydes, and Amino Compounds The phenol/aldehyde/amino compound condensates useful in making the compositions of this invention include those generically referred to as Mannich condensates. Generally they are made by reacting simultaneously or sequentially at least one active hydrogen compound such as a hydrocarbon-substituted phenol (e.g., an alkyl phenol wherein the alkyl group has at least about 30 up to about 400 carbon atoms), having at least one hydrogen atom bonded to an aromatic carbon, with at least one aldehyde or aldehyde-producing material (typically formaldehyde or formaldehyde precursor) and at least one amino or polyamino compound having at least one NH group. The amino compounds include primary or secondary mono-amines having hydrocarbon substituents of 1 to 30 carbon atoms or hydroxyl-substituted hydrocarbon substituents of 1 to about 30 carbon atoms. Another type of typical amino compound are the polyamines described during the discussion of the acylated nitrogen-containing compounds.

Exemplary mono-amines include methyl ethyl amine, methyl octadecyl amine, aniline, diethyl amine, diethanol amine, dipropyl amine and so forth. The following U.S. Patents contain extensive descriptions of Mannich condensates which can be used in making the compositions of this invention:

| U.S. PATENTS | | |
|---|---|---|
| 2,459,112 | 3,413,347 | 3,558,743 |
| 2,962,442 | 3,442,808 | 3,586,629 |
| 2,984,550 | 3,448,047 | 3,591,598 |
| 3,036,003 | 3,454,497 | 3,600,372 |
| 3,166,516 | 3,459,661 | 3,634,515 |
| 3,236,770 | 3,461,172 | 3,649,229 |
| 3,355,270 | 3,493,520 | 3,697,574 |
| 3,368,972 | 3,539,633 | |

These patents are hereby incorporated by reference for their disclosures relating to the production and use of Mannich condensate products in lubricant compositions.

Condensates made from sulfur-containing reactants can also be used in the compositions of the present invention. Such sulfur-containing condensates are described in U.S. Pat. Nos. 3,368,972; 3,649,229; 3,600,372; 3,649,659; and U.S. Pat. No. 3,741,896. These patents are also incorporated by reference for their disclosure of sulfur-containing Mannich condensates. Generally the condensates used in making the compositions of this invention are made from a phenol bearing an alkyl substituent of about 6 to about 400 carbon atoms, more typically, 30 to about 250 carbon atoms. These typical condensates are made from formaldehyde or $C_{2-7}$ aliphatic aldehyde and an amino compound such as those used in making the acylated nitrogen-containing compounds described under (B) (III).

These preferred condensates are prepared by reacting about one molar portion of phenolic compound with about 1 to about 2 molar portions of aldehyde and about 1 to about 5 equivalent portions of amino compound (an equivalent of amino compound is its molecular weight divided by the number of =NH groups present). The conditions under which such condensation reactions are carried out are well known to those skilled in the art as evidenced by the above-noted patents. Therefore, these patents are also incorporated by reference for their disclosures relating to reaction conditions.

A particularly preferred class of condensation products for use in the present invention are those made by a "2-step process" as disclosed in commonly assigned U.S. Ser. No. 451,644, filed Mar. 15, 1974, abandoned. Briefly, these nitrogen-containing condensates are made by (1) reacting at least one hydroxy aromatic compound containing an aliphatic-based or cycloaliphatic-based substituent which has at least about 30 carbon atoms and up to about 400 carbon atoms with a lower aliphatic $C_{1-7}$ aldehyde or reversible polymer thereof in the presence of an alkaline reagent, such as an alkali metal hydroxide, at a temperature up to about 150° C.; (2) substantially neutralizing the intermediate reaction mixture thus formed; and (3) reacting the neutralized intermediate with at least one compound which contains an amino group having at least one $$-\underset{|}{NH} \text{ group.}$$

More preferably, these 2-step condensates are made from (a) phenols bearing a hydrocarbon-based substituent having about 30 to about 250 carbon atoms, said substituent being derived from a polymer of propylene, 1-butene, 2-butene, or isobutene and (b) formaldehyde, or reversible polymer thereof, (e.g., trioxane, paraformaldehyde) or functional equivalent thereof, (e.g., methylal) and (c) an alkylene polyamine such as ethylene polyamines having between 2 and 10 nitrogen atoms. Further details as to this preferred class of condensates can be found in the hereinabove noted U.S. Ser. No. 451,644, which is hereby incorporated by reference, for its disclosures relating to 2-step condensates.

The following specific illustrative examples describe how to make the amino phenols and detergent/dispersants which comprise the compositions of this invention. In these examples, as well as in this specification and the appended claims, all percentages, parts and ratios are by weight, unless otherwise expressly stated to the contrary. Temperatures are in degrees centigrade (°C.) unless expressly stated to the contrary.

EXAMPLE 1A

A mixture of 4578 parts of a polyisobutene-substituted phenol prepared by boron trifluoride-phenol catalyzed alkylation of phenol with a polyisobutene having a number average molecular weight of approximately 1000 (vapor phase osmometry), 3052 parts of diluent mineral oil and 725 parts of textile spirits is heated to 60° to achieve homogenity. After cooling to 30°, 319.5 parts of 16 molar nitric acid in 600 parts of water is added to the mixture. Cooling is necessary to keep the mixture's temperature below 40°. After the reaction mixture is stirred for an additional two hours, an aliquot of 3,710 parts is transferred to a second reaction vessel. This second portion is treated with an additional 127.8 parts of 16 molar nitric acid in 130 parts of water at 25°-30°. The reaction mixture is stirred for 1.5 hours and then stripped to 220°/30 tor. Filtration provides an oil solution of the desired intermediate (IA).

EXAMPLE 1B

A mixture of 810 parts of the oil solution of the (IA) intermediate described in Example 1A, 405 parts of isopropyl alcohol and 405 parts of toluene is charged to an appropriately sized autoclave. Platinum oxide catalyst (0.81 part) is added and the autoclave is evacuated and purged with nitrogen four times to remove any residual air. Hydrogen is fed to the autoclave at a pressure of 29-55 psig while the content is stirred and heated to 27°-92° for a total of thirteen hours. Residual excess hydrogen is removed from the reaction mixture by evacuation and purging with nitrogen four times. The reaction mixture is then filtered through diatomaceous earth and the filtrate stripped to provide an oil solution of the desired amino phenol. This solution contains 0.578% nitrogen.

EXAMPLE 2

A mixture of 906 parts of an oil solution of an alkyl phenyl sulfonic acid (having an average molecular weight of 450, vapor phase osmometry), 564 parts mineral oil, 600 parts toluene, 98.7 parts magnesium oxide and 120 parts water is blown with carbon dioxide at a temperature of 78°-85° for seven hours at a rate of about 3 cubic feet of carbon dioxide per hour. The reaction mixture is constantly agitated throughout the carbonation. After carbonation, the reaction mixture is stripped to 165°/20 tor and the residue filtered. The filtrate is an oil solution of the desired overbased magnesium sulfonate having a metal ratio of about 3.

EXAMPLE 3

A polyisobutenyl succinic anhydride is prepared by reacting a chlorinated poly(isobutene) (having an average chlorine content of 4.3% and an average of 82 carbon atoms) with maleic anhydride at about 200°. The resulting polyisobutenyl succinic anhydride has a saponification number of 90. To a mixture of 1,246 parts of this succinic anhydride and 1000 parts of toluene there is added at 25° 76.6 parts of barium oxide. The mixture is heated to 115° C. and 125 parts of water is added drop-wise over a period of one hour. The mixture is then allowed to reflux at 150° C. until all the barium oxide is reacted. Stripping and filtration provides a filtrate having a barium content of 4.71%.

EXAMPLE 4

A mixture of 1500 parts of chlorinated poly(isobutene) (of molecular weight of about 950 and having a chlorine content of 5.6%), 285 parts of an alkylene polyamine having an average composition corresponding stoichiometrically to tetraethylene pentamine and 1200 parts of benzene is heated to reflux. The mixture's temperature is then slowly increased over a 4-hour period to 170° while benzene is removed. The cooled mixture is diluted with an equal volume of mixed hexanes and absolute ethanol (1:1). This mixture is heated to reflux and a ⅓ volume of 10% aqueous sodium carbonate is added to it. After stirring, the mixture is allowed to cool and the phases separated. The organic phase is washed with water and stripped to provide the desired polyisobutenyl polyamine having a nitrogen content of 4.5%.

EXAMPLE 5

A mixture of 140 parts of toluene and 400 parts of a polyisobutenyl succinic anhydride (prepared from the poly(isobutene) having a molecular weight of about 850, vapor phase osmometry) having a saponification number of 109 and 63.6 parts of an ethylene amine mixture having an average composition corresponding in stoichiometry to tetraethylene pentamine, is heated to 150° C. while the water/toluene azeotrope is removed. The reaction mixture is then heated to 150° C. under reduced pressure until toluene ceases to distill. The residual acylated polyamine has a nitrogen content of 4.7%.

EXAMPLE 6

To 1,133 parts of commercial diethylene triamine heated at 110°-150° is slowly added 6820 parts of isostearic acid over a period of two hours. The mixture is held at 150° for one hour and then heated to 180° over an additional hour. Finally, the mixture is heated to 205° over 0.5 hour; throughout this heating, the mixture is blown with nitrogen to remove volatiles. The mixture is held at 205°-230° for a total of 11.5 hours and then stripped at 230°/20 tor to provide the desired acylated polyamine as a residue containing 6.2% nitrogen.

EXAMPLE 7

To a mixture of 50 parts of a polypropyl-substituted phenol (having a molecular weight of about 900, vapor phase osmometry), 500 parts of mineral oil (a solvent refined paraffinic oil having a viscosity of 100 SUS at 100° F.) and 130 parts of 9.5% aqueous dimethylamine solution (equivalent to 12 parts amine) is added dropwise, over an hour, 22 parts of a 37% aqueous solution of formaldehyde (corresponding to 8 parts aldehyde). During the addition, the reaction temperature is slowly increased to 100° and held at that point for three hours while the mixture is blown with nitrogen. To the cooled reaction mixture is added 100 parts toluene and 50 parts mixed butyl alcohols. The organic phase is washed three times with water until neutral to litmus paper and the organic phase filtered and stripped to 200°/5–10 tor. The residue is an oil solution of the final product containing 0.45% nitrogen.

EXAMPLE 8

A mixture of 140 parts (by weight) of a mineral oil, 174 parts of a poly(isobutene) (molecular weight 1000)-substituted succinic anhydride having a saponification number of 105 and 23 parts of isostearic acid is prepared at 90° C. To this mixture there is added 17.6 parts of a mixture of polyalkylene amines having an overall composition corresponding to that of tetraethylene pentamine at 80°–100° C. throughout a period of 1.3 hours. The reaction is exothermic. The mixture is blown at 225° C. with nitrogen at a rate of 5 pounds per hour for 3 hours whereupon 47 parts of an aqueous distillate is obtained. The mixture is dried at 225° C. for 1 hour, cooled to 110° C. and filtered to provide the desired final product in oil solution.

The lubricating oils in which the nitrogen-containing additive combinations of this invention are useful can be of synthetic, animal, vegetable or mineral (e.g., petroleum) origin. Ordinarily, mineral oils are used because of their availability, general utility and low cost. In certain applications oils belonging to one of the other three classes may be used. For example, synthetic polyester oils (e.g., didodecyl adipate and pentaerythritol tetracaprylate) are often used, especially in jet engine lubrication. Mixtures of oils within one of the four classes or between such classes can often be used. Generally, the lubricating oils used will be fluid oils ranging in viscosity from about 40 SUS (Saybolt Universal Seconds) at 37.5° to 200 SUS at 99°. The additive combinations of this invention are normally used in an amount ranging from 0.5 to about 30 parts by weight combination per hundred parts of oil.

This invention also contemplates the use of other additives in the lubricating oil compositions of this invention. These other additives include such conventional additive types as anti-oxidants, extreme pressure agents, corrosion-inhibiting agents, pour point depressants, color stabilizing agents, anti-foam agents, and other such additive materials known generally to those skilled in the art of formulating lubricating oil compositions.

As noted hereinabove, the nitrogen-containing compositions of this invention are particularly useful in formulating novel lubricating oils for use in two-cycle engines. In general, the two-cycle engine lubricating oil compositions of this invention contain about 98 to about 50% oil or mixture of oils of lubricating viscosity. Typical compositions contain about 90 to about 60% oil. The presently preferred oils are mineral oils and mineral oil-synthetic polymer and/or synthetic ester oil mixtures. Polybutenes of molecular weights of about 250 to about 1,000 (as measured by vapor phase osmometry) and fatty acid ester oils of polyols such as pentaerythritol and trimethylol propane are typical synthetic oils used in preparing these two-cycle oils.

These oil compositions contain about 2 to about 30%, typically about 5 to about 20%, of at least one amino phenol as described hereinabove and about 1 to about 30%, typically 2 to about 20% of at least one detergent/dispersant. The ratio (by weight) of amino phenol to detergent/dispersant in these oils varies between about 1:10 to about 10:1. Other additives such as viscosity index (VI) improvers, lubricity agents, anti-oxidants, coupling agents, pour point depressing agents, extreme pressure agent, color stabilizers and anti-foam agents can also be present.

Polymeric VI improvers have been and are being used as bright stock replacement to improve lubricant film strength and lubrication and/or to improve engine cleanliness. Dye may be used for identification purposes and to indicate whether a two-cycle fuel contains lubricant. Coupling agents such as organic surfactants are incorporated into some products to provide better component solubilities and improved fuel/lubricant mix water tolerance.

Anti-wear and lubricity improvers, particularly sulfurized sperm oil substitutes and other fatty acid and vegetable oils, such as castor oil, are used in special applications, such as racing and for very high fuel/lubricant ratios. Scavengers or combustion chamber deposit modifiers are sometimes used to promote better spark plug life and to remove carbon deposits. Halogenated compounds and/or phosphorus-containing materials may be used for this application.

Rust and corrosion inhibitors of all types are and may be incorporated into two-cycle oil formulations. Odorants or deodorants are sometimes used for aesthetic reasons.

Lubricity agents such as synthetic polymers (e.g., polyisobutene having a number average molecular weight in the range of about 750 to about 15,000), as measured by vapor phase osmometry or gel permeation chromatography, polyol ether (e.g., poly(oxyethylene-oxypropylene)ethers) and ester oils (e.g., the ester oils described above) can also be used in the oil compositions of this invention. Natural oil fractions such as bright stocks (the relatively viscous products formed during conventional lubricating oil manufacture from petroleum) can also be used for this purpose. They are usually present in the two-cycle oil in the amount of about 3 to about 20% of the total oil composition.

Diluents such as petroleum naphthas boiling at the range of about 38°–90° (e.g., Stoddard solvent) can also be included in the oil compositions of this invention, typically in an amount of 5 to 25%.

Table 1 describes several illustrative two-cycle engine oil lubricant compositions of this invention.

TABLE 1

TWO-CYCLE ENGINE OIL BLENDS

| Example | Amino[2] Phenol of Example 1 | Detergent-Dispersant[2] Example | Detergent-Dispersant[2] Amount | Oil[1] Amount, pbw |
|---|---|---|---|---|
| A | 6 | 2 | 2 | 92 |
| B | 3 | 2 | 1 | 96 |
| C | 10.6 | 6 | 2.1 | 87.3 |
| D | 7.5 | 4 | 3.5 | 89 |
| E | 6 | 3 | 2 | 92 |
| F | 15 | 5 | 3 | 82 |

[1]The same base oil is used in each blend; this oil is a 650 neutral solvent extracted paraffinic oil cut with 20 percent by volume Stoddard solvent and containing 9 pbw per hundred parts of final blend of a bright stock having a viscosity of 150 SUS at 100° F.

[2]Part by weight of the oil solution described in the indicated Examples.

In some two-cycle engines the lubricating oil can be directly injected into the combustion chamber along with the fuel or into the fuel just prior to the time the fuel enters the combustion chamber. The two-cycle lubricants of this invention can be used in this type of engine.

As is well known to those skilled in the art, two-cycle engine lubricating oils are often added directly to the fuel to form a mixture of oil and fuel which is then introduced into the engine cylinder. Such lubricant-fuel oil mixtures are within the scope of this invention. Such lubricant-fuel blends generally contain per 1 part of oil about 15–250 parts fuel, typically they contain 1 part oil to about 50–100 parts fuel.

The fuels used in two-cycle engines are well known to those skilled in the art and usually contain a major portion of a normally liquid fuel such as hydrocarbonaceous petroleum distillate fuel (e.g., motor gasoline as defined by ASTM Specification D-439-73). Such fuels can also contain non-hydrocarbonaceous materials such as alcohols, ethers, organo-nitro compounds and the like (e.g., methanol, ethanol, diethyl ether, methyl ethyl ether, nitromethane) are also within the scope of this invention as are liquid fuels derived from vegetable or mineral sources such as corn, alfalfa, shale and coal. Examples of such fuel mixtures are combinations of gasoline and ethanol, diesel fuel and ether, gasoline and nitromethane, etc. Particularly preferred is gasoline, that is, a mixture of hydrocarbons having an ASTM boiling point of 60° C. at the 10% distillation point to about 205° C. at the 90% distillation point.

Two-cycle fuels also contain other additives which are well known to those of skill in the art. These can include anti-knock agents such as tetra-alkyl lead compounds, lead scavengers such as halo-alkanes (e.g., ethylene dichloride and ethylene dibromide), dyes, cetane, improvers, anti-oxidants such as 2,6-di-tertiary-butyl-4-methylphenol, rust inhibitors, such as alkylated succinic acids and anhydrides, bacteriostatic agents, gum inhibitors, metal deactivators, demulsifiers, upper cylinder lubricants, anti-icing agents and the like.

An example of a lubricant-fuel composition encompassed by this invention is a blend of motor gasoline and the lubricant blend described above in Example C in ratio (by weight) of 50 parts gasoline to 1 part lubricant.

Concentrates containing the nitrogen-containing compositions of this invention are also within the scope of this invention. These concentrates usually comprise about 20 to about 80% of one or more of the hereinabove described oils and about 20 to about 80% of one or more nitrogen-containing compositions. As will be readily understood by those skilled in the art, such concentrates can also contain one or more of the hereinabove described auxiliary additives of various types. Illustrative of these inventive concentrates are the following:

EXAMPLE G

A concentrate for treating 2-cycle engine oils is prepared by blending at room temperature 78.2 parts of the oil solution described in Example 1 with 21.8 parts of the oil solution described in Example 7.

EXAMPLE H

A concentrate for treating 2-cycle engine oils is prepared by heating with mild agitation a mixture of 83.4 parts of the oil solution described in Example 1 with 16.6 parts of the oil solution described in Example 6 to 110° over a period of 0.5 hour.

What is claimed is:

1. A nitrogen-containing organic composition comprising a combination of:

(A) at least one amino phenol of the general formula

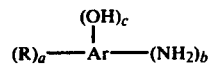

wherein R is a substantially saturated, hydrocarbon-based substituent of at least 10 aliphatic carbon atoms; a, b and c are each independently an integer of one up to three times the number of aromatic nuclei present in Ar with the proviso that the sum of a, b and c does not exceed the unsaturated valences of Ar; and Ar is an aromatic moiety having 0–3 optional substituents selected from the group consisting of lower alkyl, lower alkoxyl, nitro, halo or combinations of two or more of said substituents; and (B) at least one detergent/dispersant selected from the group consisting of (I) at least one neutral or basic metal salt of an organic sulfur acid, phenol or carboxylic acid;

(II) at least one hydrocarbyl-substituted amine wherein the hydrocarbyl substituent is substantially aliphatic and contains at least 12 carbon atoms with the proviso that said amine is not the amino phenol (A);

(III) at least one acylated, nitrogen-containing compound having a substituent of at least 10 aliphatic carbon atoms made by reacting a carboxylic acylating agent with at least one amino compound containing at least one

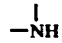

group, said acylating agent being linked to said amino compound through an imido, amido, amidine, or acyloxy ammonium linkage; and (IV) at least one nitrogen-containing condensate of a phenol, aldehyde and amino compound having at least one

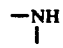

group.

2. A composition as claimed in claim 1 wherein R contains up to about 750 carbon atoms and there are no optional substituents attached to Ar.

3. A composition as claimed in claim 2 wherein R is an alkyl or alkenyl group.

4. A composition as claimed in claim 1 wherein R contains about 30 to about 750 aliphatic carbon atoms and is made from a homo- or interpolymer of $C_2$–$C_{10}$ olefins.

5. A composition as claimed in claim 4 wherein said olefins are selected from the group consisting of ethylene, propylene, butylene and mixtures thereof.

6. A composition as claimed in claim 1 wherein a, b and c are each 1, there are zero optional substituents attached to Ar, and Ar is a benzene nucleus.

7. A composition as claimed in claim 6 wherein R is an alkyl or alkenyl group of at least about 30 carbon atoms and up to about 750 carbon atoms and is derived from a homo- or interpolymer of $C_2$–$C_{10}$ 1-monoolefins.

8. A composition as claimed in claim 1 wherein the amino phenol is of the formula

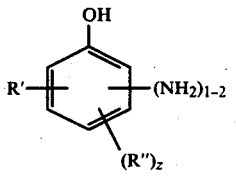

wherein R′ is a substantially saturated hydrocarbon-based substituent having an average of from about 30 to about 400 aliphatic carbon atoms, R″ is a member selected from the group consisting of lower alkyl, lower alkoxy, nitro, and halo; and z is 0 or 1.

9. A composition as claimed in claim 8 wherein R′ is a purely hydrocarbyl aliphatic group of at least about 50 carbon atoms and is made from a polymer or interpolymer of an olefin selected from the group consisting of $C_2$–$C_{10}$ 1-monoolefins and mixtures thereof.

10. A composition as claimed in claim 9 wherein z is 0.

11. A composition as claimed in claim 1 wherein the detergent/dispersant is (I) at least one neutral or basic metal salt of an organic sulfur acid, phenol or carboxylic acid.

12. A composition as claimed in claim 11 wherein the detergent/dispersant is at least one basic metal salt of an organic sulfonic acid or phenol.

13. A composition as claimed in claim 12 wherein the metal is at least one alkali or alkaline earth metal.

14. A composition as claimed in claim 12 wherein the detergent/dispersant is at least one alkaline earth metal sulfonate.

15. A composition as claimed in claim 14 wherein the sulfonate is an alkyl-substituted benzene sulfonate wherein the alkyl group has at least about 8 carbon atoms.

16. A composition as claimed in claim 15 wherein the amino phenol is of the formula

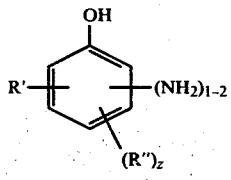

wherein R′ is a substantially saturated hydrocarbon-based substituent having an average of from about 30 to about 400 aliphatic carbon atoms, R″ is a member selected from the group consisting of lower alkyl, lower alkoxyl, nitro and halo; and z is 0 or 1.

17. A composition as claimed in claim 1 wherein the detergent/dispersant is at least one hydrocarbyl-substituted amine.

18. A composition as claimed in claim 17 wherein the hydrocarbyl amine is of the general formula

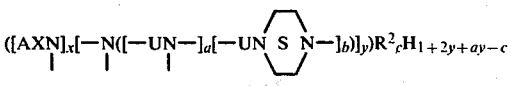

wherein A is hydrogen, a hydrocarbyl group of from 1 to 10 carbon atoms, or hydroxyhydrocarbyl group of from 1 to 10 carbon atoms; X is hydrogen, a hydrocarbyl group of from 1 to 10 carbon atoms, or hydroxyhydrocarbyl group of from 1 to 10 carbon atoms, and may be taken together with A to form a ring of from 5 to 6 annular members and up to 12 carbon atoms; U is an alkylene group of from 2 to 10 carbon atoms, $R^2$ is an aliphatic hydrocarbon group of from about 30 to 400 carbon atoms; a is an integer of from 0 to 10; b is an integer of from 0 to 1; $a+2b$ is an integer of from 1 to 10; c is an integer of from 1 to 5 and is as an average in the range of 1 to 4, and equal to or less than the number of nitrogen atoms in the molecule; x is an integer of from 0 to 1; y is an integer of from 0 to 1; and $x+y$ is equal to 1.

19. A composition as claimed in claim 18 wherein the hydrocarbyl amine is a polyamine of the general formula

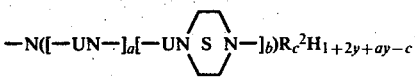

20. A composition as claimed in claim 18 wherein the amine is a monoamine of the general formula $AXNR^2$.

21. A composition as claimed in claim 17 wherein the hydrocarbyl-substituted amine is a hydrocarbyl-substituted aminohydrocarbyl morpholine of the general formula

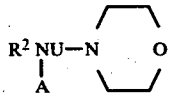

wherein $R^2$, is an aliphatic hydrocarbon group of from about 30 to about 400 carbons, A is hydrogen hydrocarbyl of from 1 to 10 carbon atoms or hydroxy hydrocarbyl group of from 1 to 10 carbon atoms and U is an alkylene group of from 2 to 10 carbon atoms.

22. A composition as claimed in claim 18 wherein the amino phenol is of the general formula

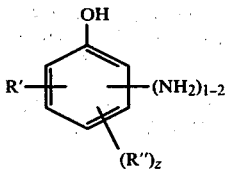

wherein R′ is a substantially saturated hydrocarbon-based substituent having an average of from about 30 to about 400 aliphatic carbon atoms; R″ is a member selected from the group consisting of lower alkyl, lower alkoxy, nitro and halo; and z is 0 or 1.

23. A composition as claimed in claim 1 wherein the detergent/dispersant is (III) at least one acylated, nitrogen-containing compound having a substituent of at least 10 aliphatic carbon atoms and made by reacting a carboxylic acylating agent with at least one amino compound containing at least one $-\overset{|}{N}H$ group, said acylating agent being linked to said amino compound through an imido, amido, amidine or acyloxy ammonium linkage.

24. A composition as claimed in claim 23 wherein the amino compound is an alkylene polyamine of the general formula $$R'''-\underset{\underset{R'''}{|}}{N}(-U-\underset{\underset{R'''}{|}}{N}\rightarrow_n R'''$$

wherein U is an alkylene group of 2 to 10 carbon atoms; each R''' is independently a hydrogen atom, a lower alkyl group or a lower hydroxy alkyl group, with the proviso that at least one R''' is a hydrogen atom, and n is 1 to 10.

25. A composition as claimed in claim 24 wherein the acylating agent is a mono- or polycarboxylic acid, or reactant equivalent thereof, containing an aliphatic hydrocarbyl substituent of at least about 30 carbon atoms.

26. A composition as claimed in claim 25 wherein the substituent is made from a homo- or interpolymer of a $C_{2-10}$ 1-monoolefin or mixtures thereof.

27. A composition as claimed in claim 26 wherein the homo- or interpolymer is of ethylene, propylene, 1-butene, 2-butene, isobutene or mixtures thereof.

28. A composition as claimed in claim 27 wherein the amino phenol is of the formula

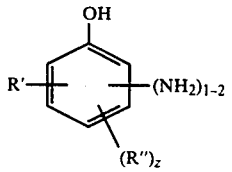

wherein R' is a substantially saturated hydrocarbon-based substituent having an average of from about 30 to about 400 aliphatic carbon atoms located ortho or para to the hydroxyl group; R'' is a member selected from the group consisting of lower alkyl, lower alkoxyl, nitro and halo; and z is 0 or 1.

29. A composition as claimed in claim 24 wherein the acylating agent is at least one mono-carboxylic acid, or reactant equivalent thereof, having from 12 to 30 carbon atoms.

30. A composition as claimed in claim 29 wherein the acylating agent is a mixture of fatty monocarboxylic acids, or reactant equivalent thereof, having straight and branched carbon chains.

31. A composition as claimed in claim 30 wherein the amino compound is an ethylene, propylene or trimethylene polyamine of at least 2 to about 8 amino groups or mixtures of such polyamines.

32. A composition as claimed in claim 31 wherein the amino phenol is of the formula

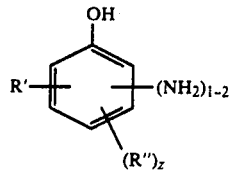

wherein R' is a substantially saturated hydrocarbon-based substituent having an average of from about 30 to about 400 aliphatic carbon atoms; R'' is a member selected from the group consisting of lower alkyl, lower alkoxyl, nitro and halo; and z is 0 or 1.

33. A composition as claimed in claim 1 wherein the detergent/dispersant is a (IV) nitrogen-containing condensate of a phenol, aldehyde and amino compound having at least one $-\overset{|}{N}H$ group.

34. A composition as claimed in claim 33 wherein the phenol is an alkyl-substituted phenol, the alkyl group having at least about 30 carbon atoms.

35. A composition as claimed in claim 34 wherein the aldehyde is formaldehyde, or a reactant equivalent thereof.

36. A composition as claimed in claim 35 wherein the amino compound is of the formula $$R'''-\underset{\underset{R'''}{|}}{N}(-U-\underset{\underset{R'''}{|}}{N}\rightarrow_n R'''$$

wherein U is an alkylene group of 2 to 10 carbon atoms; each R''' is independently a hydrogen atom, a lower alkyl group or a lower hydroxy alkyl group, with the proviso that at least one R''' is a hydrogen atom, and n is 1 to 10.

37. A composition as claimed in claim 36 wherein the condensate is made by first reacting the phenol with the aldehyde in the presence of an alkaline catalyst at a temperature of up to 150°, then neutralizing the intermediate reaction mixture thus formed and finally reacting the neutralized intermediate reaction mixture with at least one amino compound having at least one $-\overset{|}{N}H$ group.

38. A composition as claimed in claim 33 wherein the amino phenol is of the formula

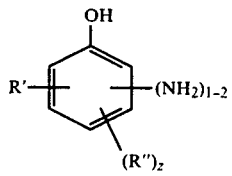

wherein R' is a substantially saturated hydrocarbon-based substituent having an average of from about 30 to about 400 aliphatic carbon atoms; R'' is a member selected from the group consisting of lower alkyl, lower alkoxyl, nitro and halo; and z is 0 or 1.

39. A composition as claimed in claim 37 wherein the amino phenol is of the formula

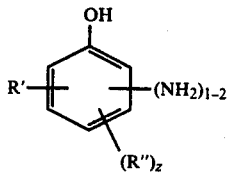

wherein R' is a substantially saturated hydrocarbon-based substituent having an average of from about 30 to about 400 aliphatic carbon atoms; R'' is a member selected from the group consisting of lower alkyl, lower alkoxyl, nitro and halo; and z is 0 or 1.

40. A composition as claimed in claim 1 wherein the ratio by weight of amino phenol to the total amount of detergent/dispersant is in the range of about 1:10 to about 10:1.

41. A composition as claimed in claim 9 wherein the ratio by weight of amino phenol to the total amount of detergent/dispersant is in the range of about 1:10 to about 10:1.

42. A lubricant composition for two-cycle engines comprising a major amount by weight of at least one oil of lubricating viscosity and a minor amount by weight of a composition as claimed in claim 1.

43. A lubricant composition for two-cycle engines comprising a major amount by weight of at least one oil of lubricating viscosity and a minor amount by weight of a composition as claimed in claim 8.

44. A composition as claimed in claim 43 wherein R' is a purely hydrocarbyl aliphatic group of at least about 50 carbon atoms and is made from a polymer or interpolymer of an olefin selected from the group consisting of $C_{2-10}$ 1-monoolefin and mixtures thereof.

45. A lubricant composition for two-cycle engines comprising a major amount by weight of at least one oil of lubricating viscosity and a minor amount by weight of a composition as claimed in claim 18.

46. A lubricant composition for two-cycle engines comprising a major amount by weight of at least one oil of lubricating viscosity and a minor amount by weight of a composition as claimed in claim 21.

47. A lubricant composition for two-cycle engines comprising a major amount by weight of at least one oil of lubricating viscosity and a minor amount by weight of a composition as claimed in claim 22.

48. A lubricant-fuel mixture for use in two-cycle internal combustion engines wherein the lubricant is the composition claimed in claim 42.

49. A lubricant-fuel mixture for use in two-cycle internal combustion engines wherein the lubricant is the composition claimed in claim 43.

50. A lubricant-fuel mixture for use in two-cycle internal combustion engines wherein the lubricant is the composition claimed in claim 44.

51. A lubricant-fuel mixture for use in two-cycle internal combustion engines wherein the lubricant is a lubricant composition for two-cycle engines comprising a major amount by weight of at least one oil of lubricating viscosity and a minor amount by weight of a composition as claimed in claim 11.

52. A lubricant-fuel mixture for use in two-cycle internal combustion engines wherein the lubricant is a lubricant composition for two-cycle engines comprising a major amount by weight of at least one oil of lubricating viscosity and a minor amount by weight of a composition as claimed in claim 23.

53. A lubricant-fuel mixture for use in two-cycle internal combustion engines wherein the lubricant is a lubricant composition for two-cycle engines comprising a major amount by weight of at least one oil of lubricating viscosity and a minor amount by weight of a composition as claimed in claim 25.

54. A lubricant-fuel mixture for use in two-cycle internal combustion engines wherein the lubricant is a lubricant composition for two-cycle engines comprising a major amount by weight of at least one oil of lubricating viscosity and a minor amount by weight of a composition as claimed in claim 30.

55. A lubricant-fuel mixture for use in two-cycle internal combustion engines wherein the lubricant is a lubricant composition for two-cycle engines comprising a major amount by weight of at least one oil of lubricating viscosity and a minor amount by weight of a composition as claimed in claim 37.

56. In the method for lubricating a two-cycle internal combustion engine, the improvement which comprises using a lubricant composition as claimed in claim 42.

57. In the method for lubricating a two-cycle internal combustion engine, the improvement which comprises using a lubricant composition as claimed in claim 43.

58. In the method for lubricating a two-cycle internal combustion engine, the improvement which comprises using a lubricant composition as claimed in claim 44.

59. In the method for lubricating a two-cycle internal combustion engine, the improvement which comprises using a lubricant composition comprising a major amount by weight of at least one oil of lubricating viscosity and a minor amount by weight of a composition as claimed in claim 25.

60. In the method for lubricating a two-cycle internal combustion engine, the improvement which comprises using a lubricant composition comprising a major amount by weight of at least one oil of lubricating viscosity and a minor amount by weight of a composition as claimed in claim 30.

61. In the method for lubricating a two-cycle internal combustion engine, the improvement which comprises using a lubricant composition comprising a major amount by weight of at least one oil of lubricating viscosity and a minor amount by weight of a composition as claimed in claim 37.

62. A composition as claimed in claim 1 wherein the amino phenol (A) is made by:

(I) nitrating with at least one nitrating agent at least one compound of the formula

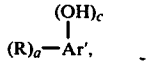

wherein R is a substantially saturated hydrocarbon-based group of at least 10 aliphatic carbon atoms; a and c are each independently an integer of 1 up to three times the number of aromatic nuclei present in Ar with the proviso that the sum of a and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

63. A composition as claimed in claim 11 wherein the amino phenol (A) is made by:

(I) nitrating with at least one nitrating agent at least one compound of the formula $$(R)_a-\overset{\overset{(OH)_c}{|}}{Ar'},$$

wherein R is a substantially saturated hydrocarbon-based group of at least 10 aliphatic carbon atoms; a and c are each independently an integer of 1 up to three times the number of aromatic nuclei present in Ar with the proviso that the sum of a and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

64. A composition as claimed in claim 17 wherein the amino phenol (A) is made by:

(I) nitrating with at least one nitrating agent at least one compound of the formula $$(R)_a-\overset{\overset{(OH)_c}{|}}{Ar'},$$

wherein R is a substantially saturated hydrocarbon-based group of at least 10 aliphatic carbon atoms; a and c are each independently an integer of 1 up to three times the number of aromatic nuclei present in Ar with the proviso that the sum of a and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

65. A composition as claimed in claim 25 wherein the amino phenol (A) is made by:

(I) nitrating with at least one nitrating agent at least one compound of the formula $$(R)_a-\overset{\overset{(OH)_c}{|}}{Ar'},$$

wherein R is a substantially saturated hydrocarbon-based group of at least 10 aliphatic carbon atoms; a and c are each independently an integer of 1 up to three times the number of aromatic nuclei present in Ar with the proviso that the sum of a and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

66. A composition as claimed in claim 33 wherein the amino phenol (A) is made by:

(I) nitrating with at least one nitrating agent at least one compound of the formula $$(R)_a-\overset{\overset{(OH)_c}{|}}{Ar'},$$

wherein R is a substantially saturated hydrocarbon-based group of at least 10 aliphatic carbon atoms; a and c are each independently an integer of 1 up to three times the number of aromatic nuclei present in Ar with the proviso that the sum of a and c does not exceed the unsatisfied valences of Ar'; and Ar' is an aromatic moiety having 0 to 3 optional substituents selected from the group consisting of lower alkyl, lower alkoxyl, nitro, and halo, or combinations of two or more optional substituents, with the provisos that (a) Ar' has at least one hydrogen atom directly bonded to a carbon atom which is part of an aromatic nucleus, and (b) when Ar is a benzene having only one hydroxyl and one R substituent, the R substituent is ortho or para to said hydroxyl substituent, to form a first reaction mixture containing a nitro intermediate, and (II) reducing at least about 50% of the nitro groups in said first reaction mixture to amino groups.

67. A composition as claimed in claim 1 wherein the amino phenol is made by reducing at least about 50% of the nitro groups to amino groups in a compound or mixture of compounds of the formula $$(R)_a-\overset{\overset{(OH)_c}{|}}{Ar}-(NO_2)_b$$

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

68. A composition as claimed in claim 11 wherein the amino phenol is made by reducing at least about 50% of the nitro groups to amino groups in a compound or mixture of compounds of the formula

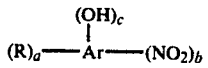

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

69. A composition as claimed in claim 17 wherein the amino phenol is made by reducing at least about 50% of the nitro groups to amino groups in a compound or mixture of compounds of the formula

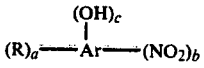

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

70. A composition as claimed in claim 25 wherein the amino phenol is made by reducing at least about 50% of the nitro groups to amino groups in a compound or mixture of compounds of the formula

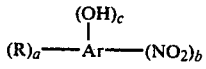

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

71. A composition as claimed in claim 33 wherein the amino phenol is made by reducing at least about 50% of the nitro groups to amino groups in a compound or mixture of compounds of the formula

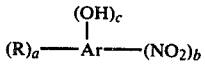

wherein R is a substantially saturated hydrocarbon-based substituent of at least 10 aliphatic carbon atoms; a, b and c are each independently an integer of 1 up to three times the number of aromatic nuclei present in Ar with the proviso that the sum of a, b and c does not exceed the unsatisfied valences of Ar; and Ar is an aromatic moiety having 0 to 3 optional substituents selected from the group consisting of lower alkyl, lower alkoxyl, halo, or combinations of two or more of said optional substituents; with the proviso that when Ar is a benzene nucleus having only one hydroxyl and one R substituent, the R substituent is ortho or para to said hydroxyl substituent.

* * * * *